US006976938B2

(12) United States Patent
Johnston

(10) Patent No.: US 6,976,938 B2
(45) **Date of Patent: *Dec. 20, 2005**

(54) MOTIONING EXERCISE APPARATUS

(76) Inventor: Gary Lawrence Johnston, P.O. Box 183, Cowarts, AL (US) 36321

( * ) Notice: Subject to any disclaimer, the term of this patent is extended or adjusted under 35 U.S.C. 154(b) by 255 days.

This patent is subject to a terminal disclaimer.

(21) Appl. No.: 10/264,436

(22) Filed: Oct. 3, 2002

(65) Prior Publication Data

US 2003/0032527 A1 Feb. 13, 2003

Related U.S. Application Data

(63) Continuation of application No. 09/872,812, filed on Jun. 4, 2001, now Pat. No. 6,475,120, which is a continuation of application No. 09/277,120, filed on Mar. 26, 1999, now Pat. No. 6,273,841.

(51) Int. Cl.[7] ..... A63B 22/14
(52) U.S. Cl. ..... 482/51; 482/131; 482/136
(58) Field of Search ..... 482/57, 62, 72–73, 482/140, 51, 131, 136, 142, 147, 907, 146; D21/687

(56) References Cited

U.S. PATENT DOCUMENTS 4,313,603 A * 2/1982 Simjian ..... 482/147
4,391,441 A * 7/1983 Simjian ..... 482/131
4,586,706 A * 5/1986 Chen ..... 482/62
4,638,996 A * 1/1987 Simjian ..... 482/147
4,948,124 A * 8/1990 Ghaly ..... 482/118
5,052,684 A * 10/1991 Kosuge et al. ..... 482/118
5,433,690 A * 7/1995 Gilman ..... 482/146
5,888,176 A * 3/1999 Kuo ..... 482/53
5,931,765 A * 8/1999 Huang ..... 482/57
5,967,610 A * 10/1999 Lin ..... 297/340
6,273,841 B1 * 8/2001 Johnston ..... 482/51
6,475,120 B2 * 11/2002 Johnston ..... 482/51

* cited by examiner

*Primary Examiner*—Stephen R. Crow

(57) ABSTRACT

A motioning exercise apparatus is provided which enables the user to exercise both upper and lower body muscle groups. The apparatus includes a frame means, with a hand engagement means, a seat support means, and a power transfer means are all pivotally mounted to the frame means. The user may alternately push and pull backward and forward upon two handle members of the hand engagement means. This motion is transferred by a power transfer means into revolving or pivoting motion of a seat of the seat support means. Also, pivoting movement of the seat will produce alternating backward and forward movement of the handle members. Optional items include a back support means, inner and outer thigh engagement means, and a resistance means.

12 Claims, 10 Drawing Sheets

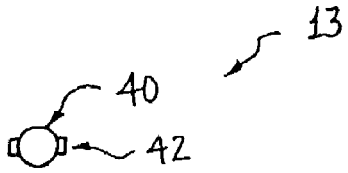
FIGURE 4B
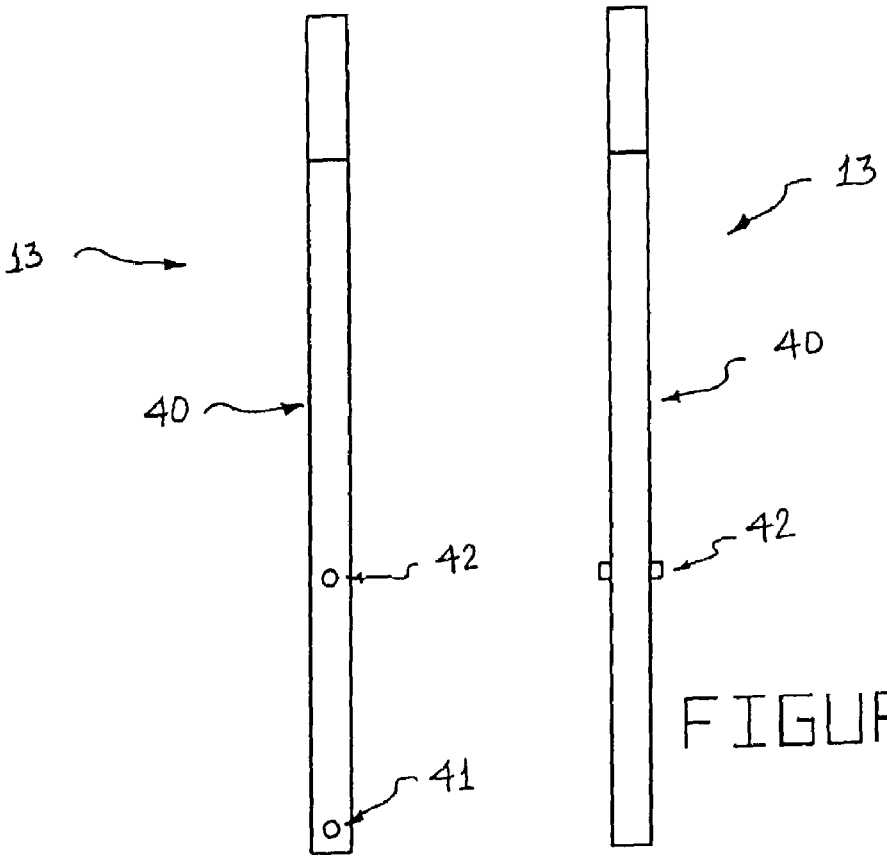
FIGURE 4C
FIGURE 4A

FIGURE 5A
FIGURE 5B
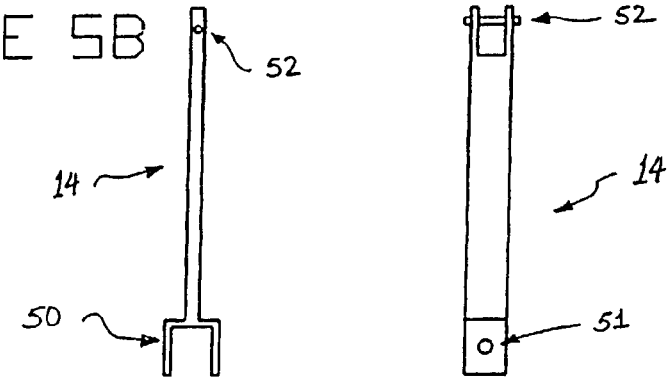
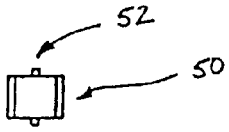
FIGURE 5C
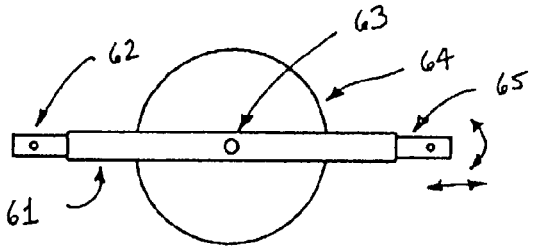
FIGURE 6B
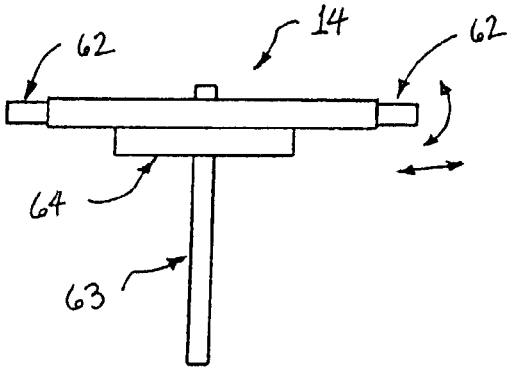
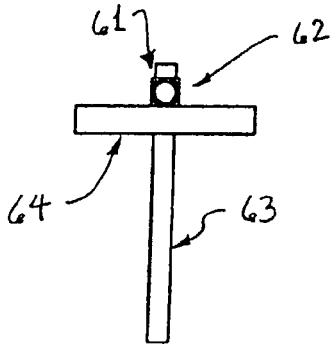
FIGURE 6A FIGURE 6C

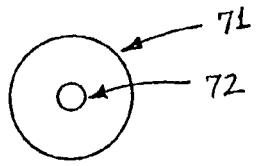
FIGURE 7B
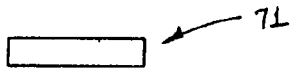
FIGURE 7A
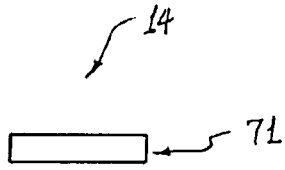
FIGURE 7C
FIGURE 8A
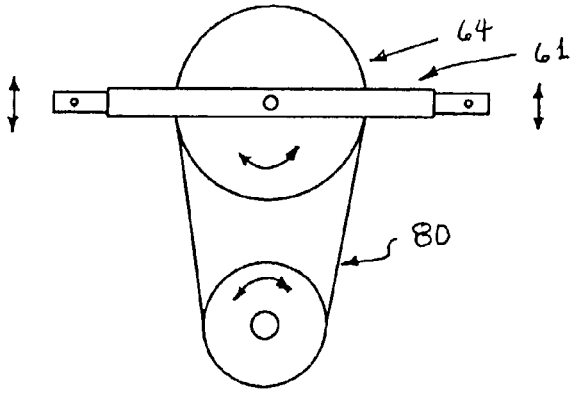
FIGURE 8B
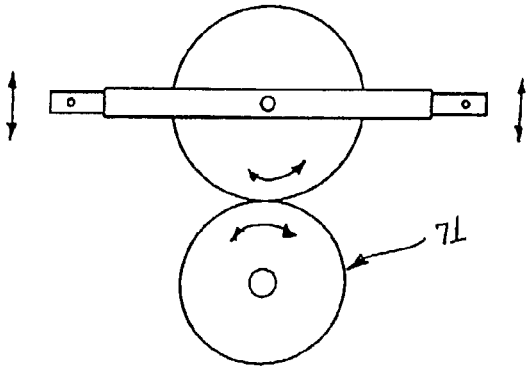
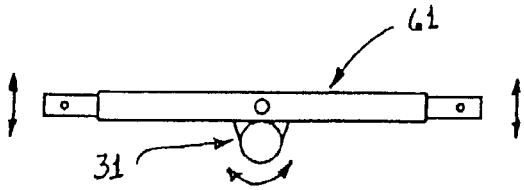
FIGURE 8C FIGURE 10A
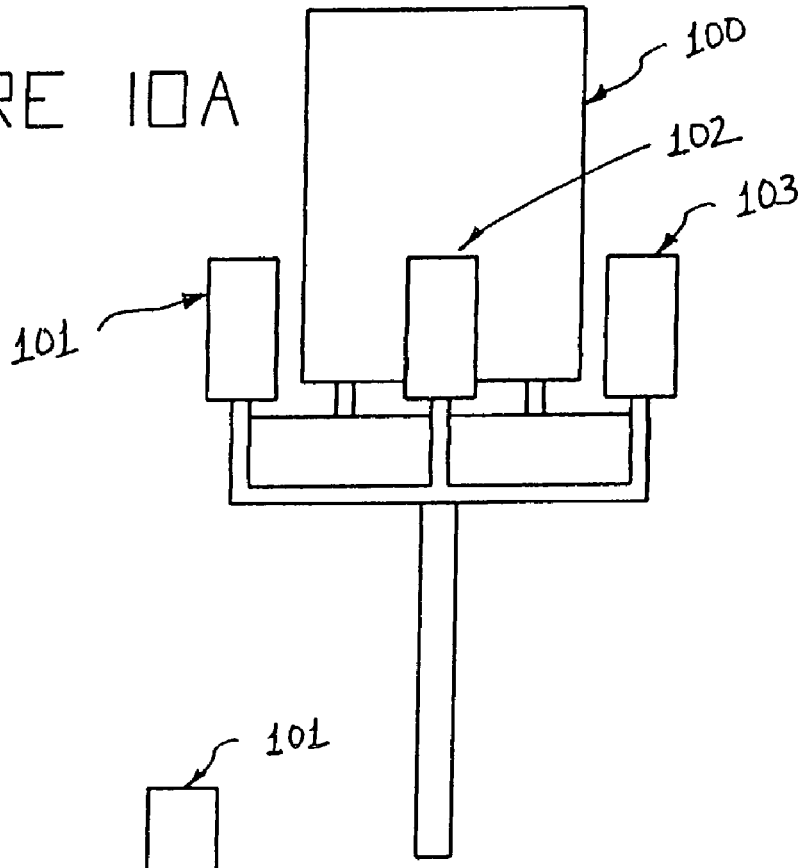
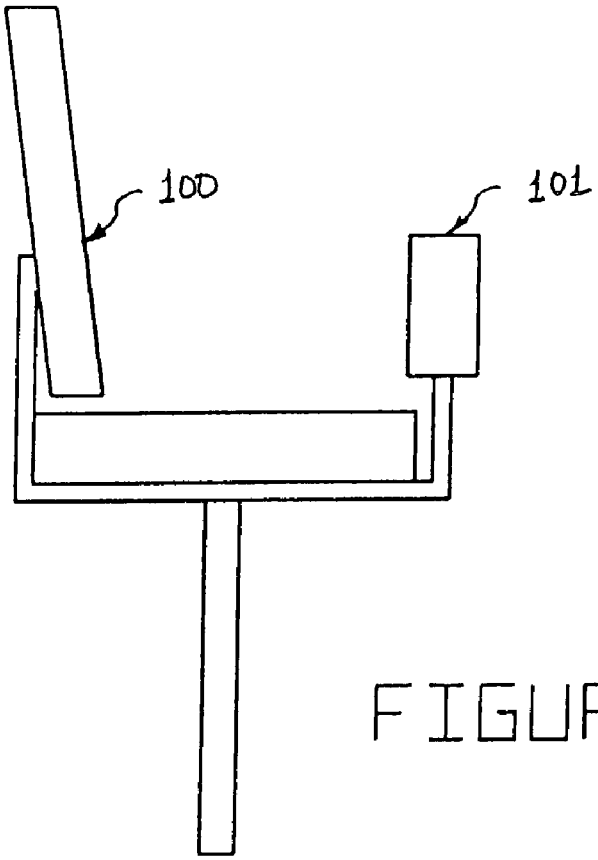
FIGURE 10B

MOTIONING EXERCISE APPARATUS

CROSS REFERENCE TO RELATED APPLICATIONS

This application is a Continuation of U.S. patent application Ser. No. 09/872,812 filed Jun. 4, 2001, now U.S. Pat. No. 6,475,120 which is itself a Continuation of U.S. patent application Ser. No. 09/277,120, filed Mar. 26, 1999, now U.S. Pat. No. 6,273,841.

BACKGROUND OF THE INVENTION

This invention relates to a motioning exercise apparatus which has an upright structure that allows the user to perform twisting exercise routines while in a sitting position. This feature allows for a better upper and lower body workout than provided by more conventional upper and lower body combination exercise devices.

SUMMARY AND OBJECTS OF THE INVENTION

It is the object of this invention to provide an exercise apparatus which may provide the user a well balanced upper and lower body combination exercise routine. The main purpose of this application is to demonstrate an apparatus which performs the stated function, and to demonstrate the many options and configurations this apparatus may take on.

Briefly stated, the apparatus that forms the basis of the present invention comprises a frame means, a seat support means, a hand engagement means, and a power transfer means. The seat support means, hand emgagement means, and the power transfer means are all mounted upon the frame means. Optional items include a back support means and thigh engagement means associated with the seat support means. Also, an optional resistance means may be supported by the frame means, and operatively connect the hand engagement means and the seat support means.

The design of the apparatus is such that the hand engagement means is moveable in the forward and backward directions with respect to the frame means. This movement causes the seat support means to twist or pivot in the clockwise and counter-clockwise directions. Conversely, pivoting motion in the seat support means produces forward and backward motion in the hand engagement means. This provides the user an exercise routine for many of the upper and lower body muscle groups. Other obects, feeatures, and advantages for this invention will be apparent from the following detailed description and the appended claims, references being made to the accompanying drawings forming a part of the specification, wherein like reference numerals designate corresponding parts of the several views.

BRIEF DESCRIPTION OF THE DRAWINGS

FIG. 4A is a front view of the hand engagement means of the motioning exercise apparatus.

FIG. 4B is a top view of the hand engagement means of the motioning exercise apparatus.

FIG. 4C is a side view of the hand engagement means of the motioning exercise apparatus.

FIG. 5A is a front view of one part of the power transfer means of the motioning exercise apparatus.

FIG. 5B is a top view of one part of the power transfer means of the motioning exercise apparatus.

FIG. 5C is a side view of one part of the power transfer means of the motioning exercise apparatus.

FIG. 6A is a front view of a second part of the power transfer means of the motioning exercise apparatus.

FIG. 6B is a top view of a second part of the power transfer means of the motioning exercise apparatus.

FIG. 6C is a side view of a second part of the power transfer means of the motioning exercise apparatus.

FIG. 7A is a front view of a third part of the power transfer means of the motioning exercise apparatus.

FIG. 7B is a top view of a third part of the power transfer means of the motioning exercise apparatus.

FIG. 7C is a side view of a third part of the power transfer means of the motioning exercise apparatus.

FIG. 8A is a top view of one type of power transfer means which utilizes a chain and sprocket system.

FIG. 8B is a top view of a second type of power transfer means which utilizes a gear assembly.

FIG. 8C is a top view of a third type of power transfer means.

FIGS. 10A and 10B demonstrate optional back support means and thigh engagement means which may be part of the seat support means.

DETAILED DESCRIPTION OF THE PREFERRED EMBODIMENT

Before explaining in detail the present invention, it is to be understood that the invention is not limited in its application to the details of construction or arrangement of parts illustrated in the accompanying drawings, since the invention is capable of other embodiments and of being practiced or carried out in various ways. Also, it is to be understood that the phraseology and terminology employed herein is for the purpose of description, and not limitation.

Figure 1A:
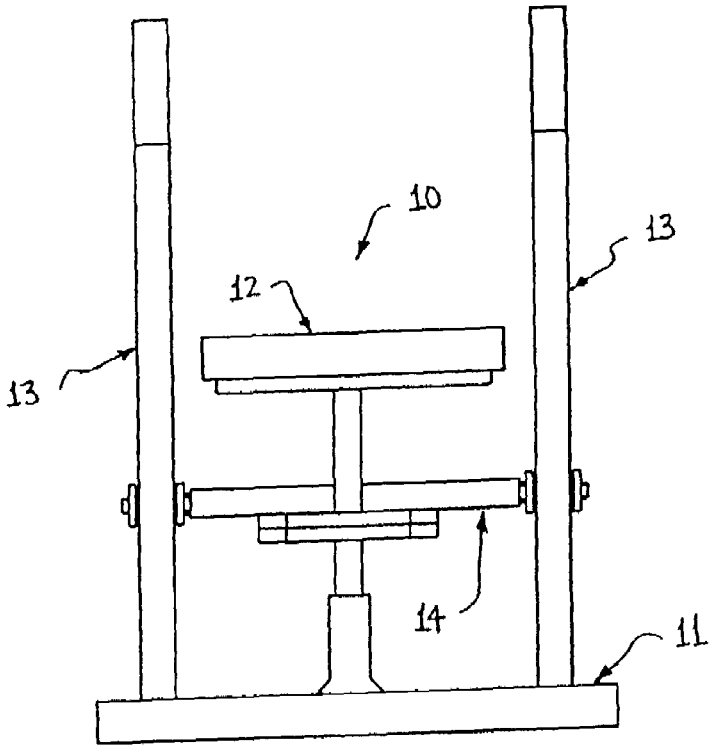
FIG. 1A is a front view of the motioning exercise apparatus.
Figure 1B:
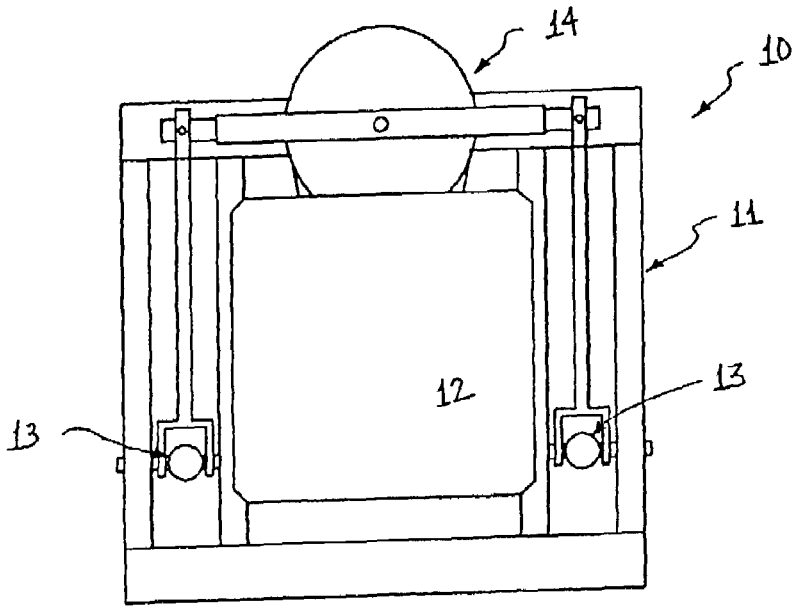
FIG. 1B is a top view of the motioning exercise apparatus.
Figure 1C:
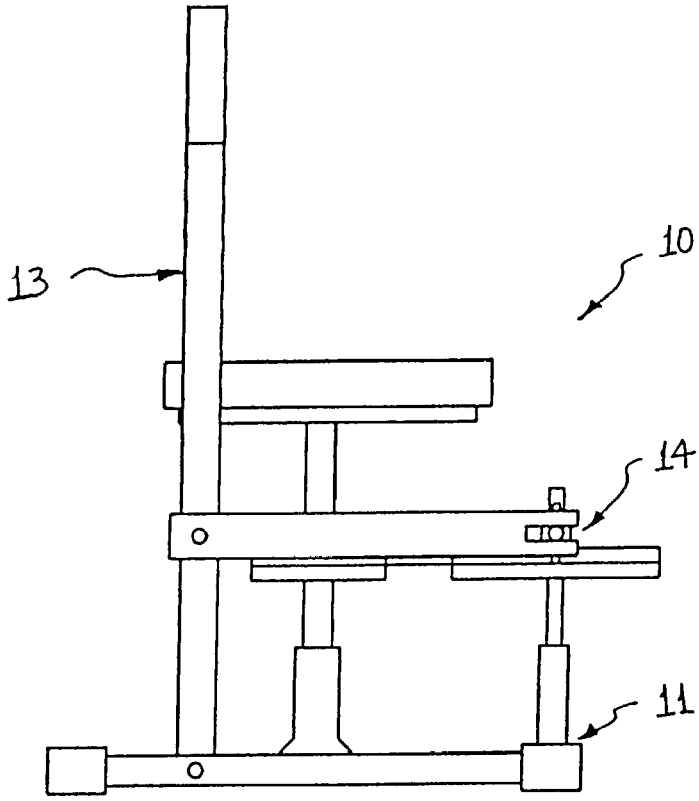
FIG. 1C is a side view of the motioning exercise apparatus.

As best can be seen by references to the drawings, and in particular to FIGS. 1A–1C, the motioning exercise apparatus that forms the basis of the present invention is designated generally by the reference numeral 10, and includes a frame means 11, a seat support means 12, a hand engagement means 13, and a power transfer means 14. The seat support means 12, hand engagement means 13, and the power transfer means 14 are all mounted on frame means 11.

Figure 2A:
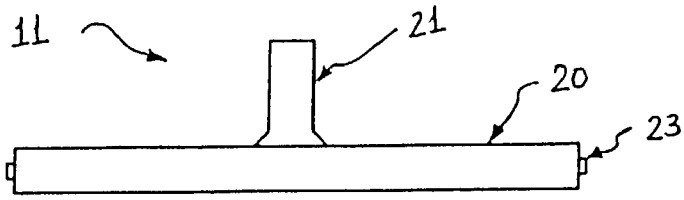
FIG. 2A is a front view of the frame means of the motioning exercise apparatus.
Figure 2B:
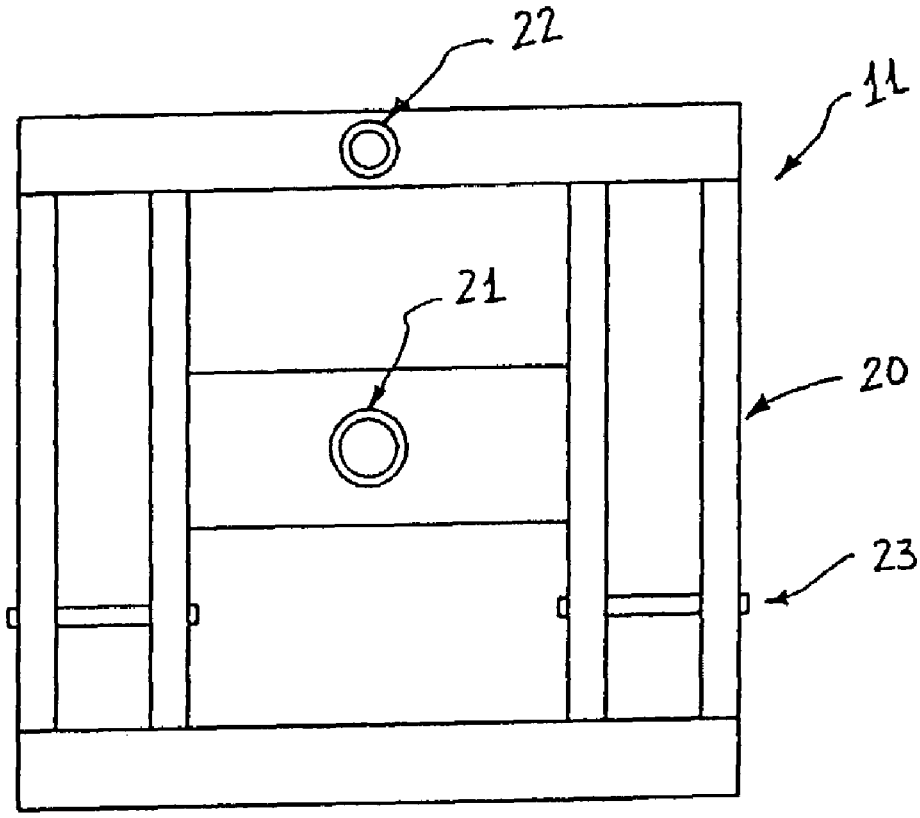
FIG. 2B is a top view of the frame means of the motioning exercise apparatus.
Figure 2C:
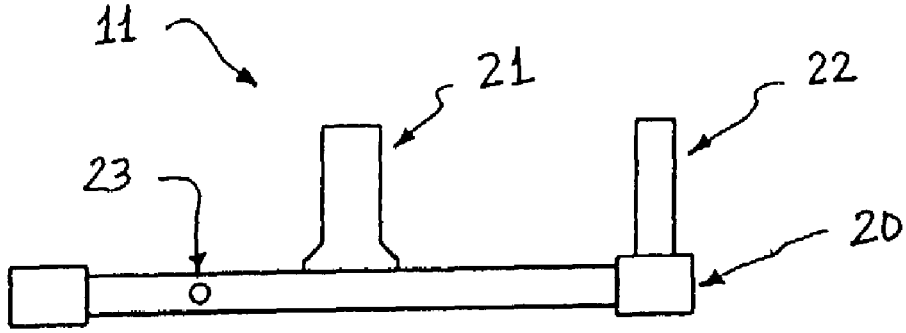
FIG. 2C is a side view of the frame means of the motioning exercise apparatus.

As may be seen in FIGS. 2A–2C, the frame means 11 comprises a base 20, a seat mount 21, a power transfer mount 22, and handle mounts 23. The seat mount 21 is used to support seat support means 12, while the handle mounts 23 are used to support hand engagement means 13. Power transfer mount 22 is used to support the power transfer means 14.

Figure 3B:
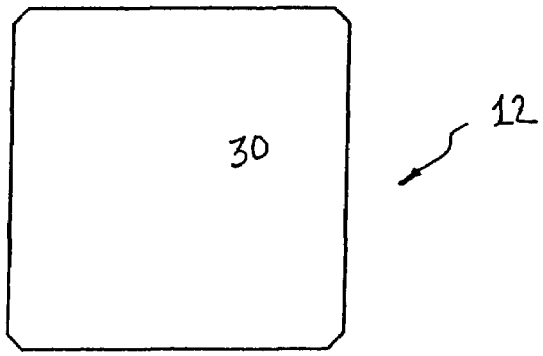
FIG. 3B is a top view of the seat support means of the motioning exercise apparatus.
Figure 3A:
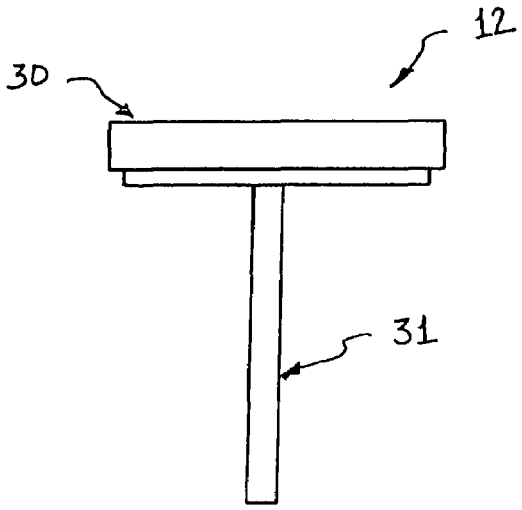
FIG. 3A is a front view of the seat support means of the motioning exercise apparatus.
Figure 3C:
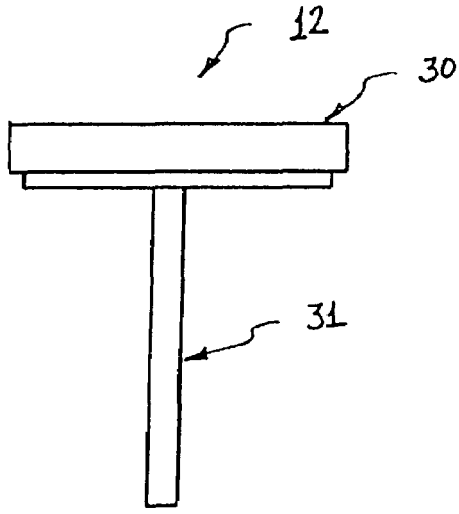
FIG. 3C is a side view of the seat support means of the motioning exercise apparatus.

As may also be seen in FIGS. 3A–3C, the seat support means 12 comprises a seat 30 and a seat support member 31. Seat support member 31 is used to support seat 30.

As may be seen in FIGS. 4A–4C, the hand engagement means is comprised of two handle members 40. Each handle member 40 includes a base mount opening 41 and a power transfer connector 42.

FIGS. 5A–7C demonstrate the various components of the power transfer means 14. FIGS. 5A–5C demonstrate a handle connector 50 having a handle mount opening 51 and a lever connector 52. The power tranfer means 14 has two handle connectors 50, one for each handle member 40. FIGS. 6A–6C demonstrate a lever member 61 having adaptably adjustable lever end segments 62. Each end segment 62 has a lever end segment opening 65. Also shown is lever support member 63 and lever rotatable member 64. FIGS. 7A–7C demonstrate the seat rotatable member 71 having a seat rotatable member opening 72.

As may be seen in FIGS. 1A–1C, and FIG. 8A, the handle members 40 of hand engagement means 13 are pivotally mounted to handle mounts 23 of frame means 11, and extend in a generally upward direction from said frame means 11. Seat support member 31 of seat support means 12 is pivotally mounted to seat mount 21 of frame means 11, and also extends in a generally upward direction from said frame means 11. Seat 30 is rigidly mounted to seat support member 31. Also, seat rotatable member 71 of power transfer means 14 is rigidly mounted to seat support member 31 through seat rotatable member opening 72. Lever support member 63 of power transfer means 14 is pivotally mounted to power transfer mount 22 of frame means 11, and extends in a generally upward direction from said frame means. Both lever member 61 and lever rotatable member 64 are rigidly mounted to lever support member 63, at a generally perpendicular angle. Lever member 61 has lever end segments 62 loosely mounted within, such that they may move in the inward and outward directions, and also rotate within lever member 61. Each handle connector 52 of power transfer means 14 pivotally connects to a handle member 40 of hand engagement means 13 through power transfer connector 42. The other end of handle connector 52 has a lever connector 52 which pivotally connects to lever end segment 62 through lever end segment opening 65. A closed loop connection means 80 connects lever rotatable member 64 and seat rotatable member 71.

Figure 9A:
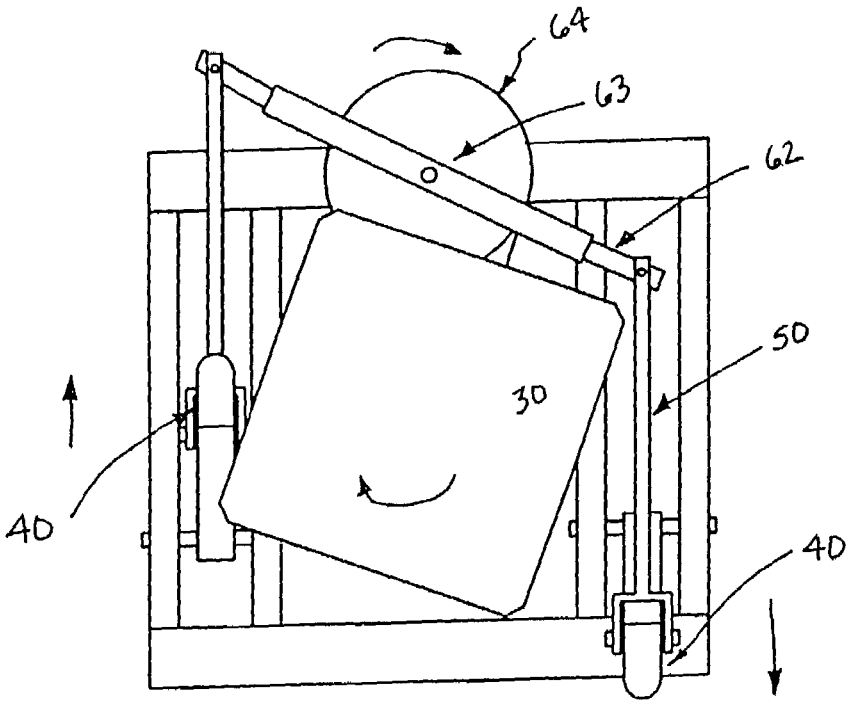
FIGS. 9A and 9B are top views of the motioning exercise appartus while in operation.
Figure 9B:
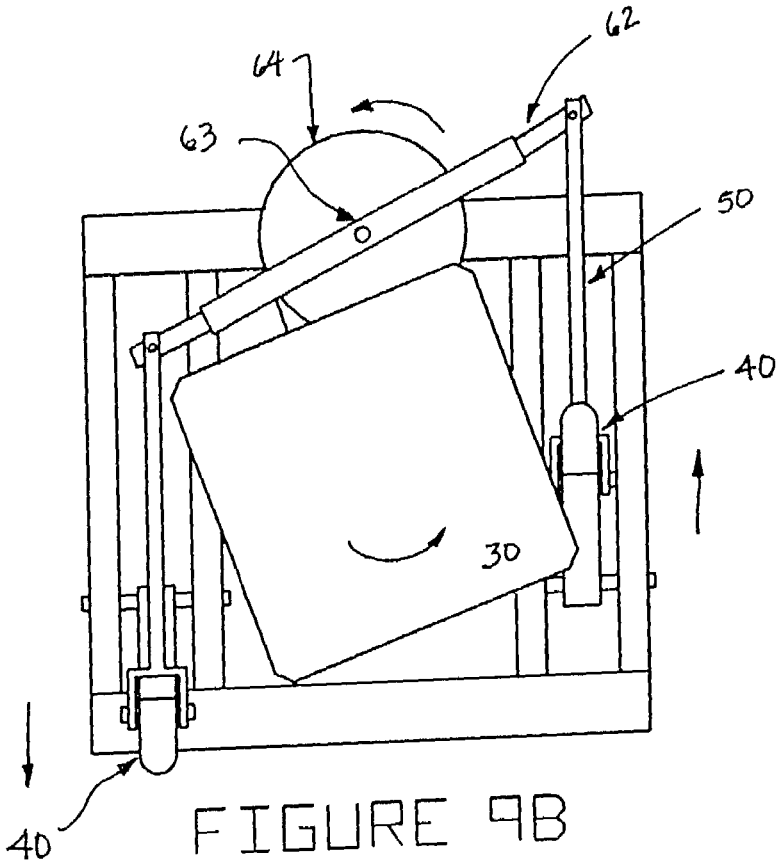

The operation of the motioning exercise apparatus may be seen in FIGS. 9A–9B. Handle members 40 are mounted on opposite sides of the frame means 11, and move in the forward and backward directions, opposite one another. As the handle members 40 move, forward and backward motion is produced in lever member 61, and a backward and forward pivoting motion is produced in lever rotatable member 64. Lever rotatable member 64 produces a similar pivoting motion in seat rotatable member 71, since they are connected together by a closed loop connection means 80. The motion in seat rotatable member 71 causes the seat 30 to pivot backward and forward. Thus, movement of the handle members 40 causes pivoting motion in seat 30. The reverse is also true. Pivoting motion in the seat 30 will produce forward and backward motion of the handle members 40. Lever member 31 produces the alternating movement of the handle members 40. The preferred operation of the apparatus is that forward movement of the right side handle member 40 corresponds to counter-clockwise pivoting movement of the seat 30, and forward movement of the left side handle member 40 corresponds to clockwise pivoting movement of seat 30.

FIGS. 8B and 8C demonstrate other possible configurations for the transfer of motion between the handle members 40 and the seat member 30. FIG. 8B demonstrates a gear assembly configuration in which both lever rotatable member 64 and seat rotatable member 71 are gears with interfacing teeth. FIG. 8C demonstrates how lever member 61 may mount directly to seat support member 31. The preferred embodiment is the closed loop connection configuration shown in FIG. 8A, which may be a chain and sprocket assembly. Compared to the direct mounting of the lever member 61 and the seat support member 31, this configuration will produced a larger pivoting motion in the seat 30, with less movement of the handle members 40, provided seat support member 31 is smaller than lever rotatable member 64. This would also be true of the gear assembly configuration. Many other variations of the power transfer means exist which will perform the same indicated function.

FIGS. 10A and 10B demonstrate optional items which may be added to the seat support means 12 to improve the device. Back support member 100 may be added to make the device more comfortable. Outer thigh engagement members 101 and 103, and inner thigh engagement member 102 provide the user more operational features. The user may press their thighs against these members to enhance their workout routines.

Figure 11:
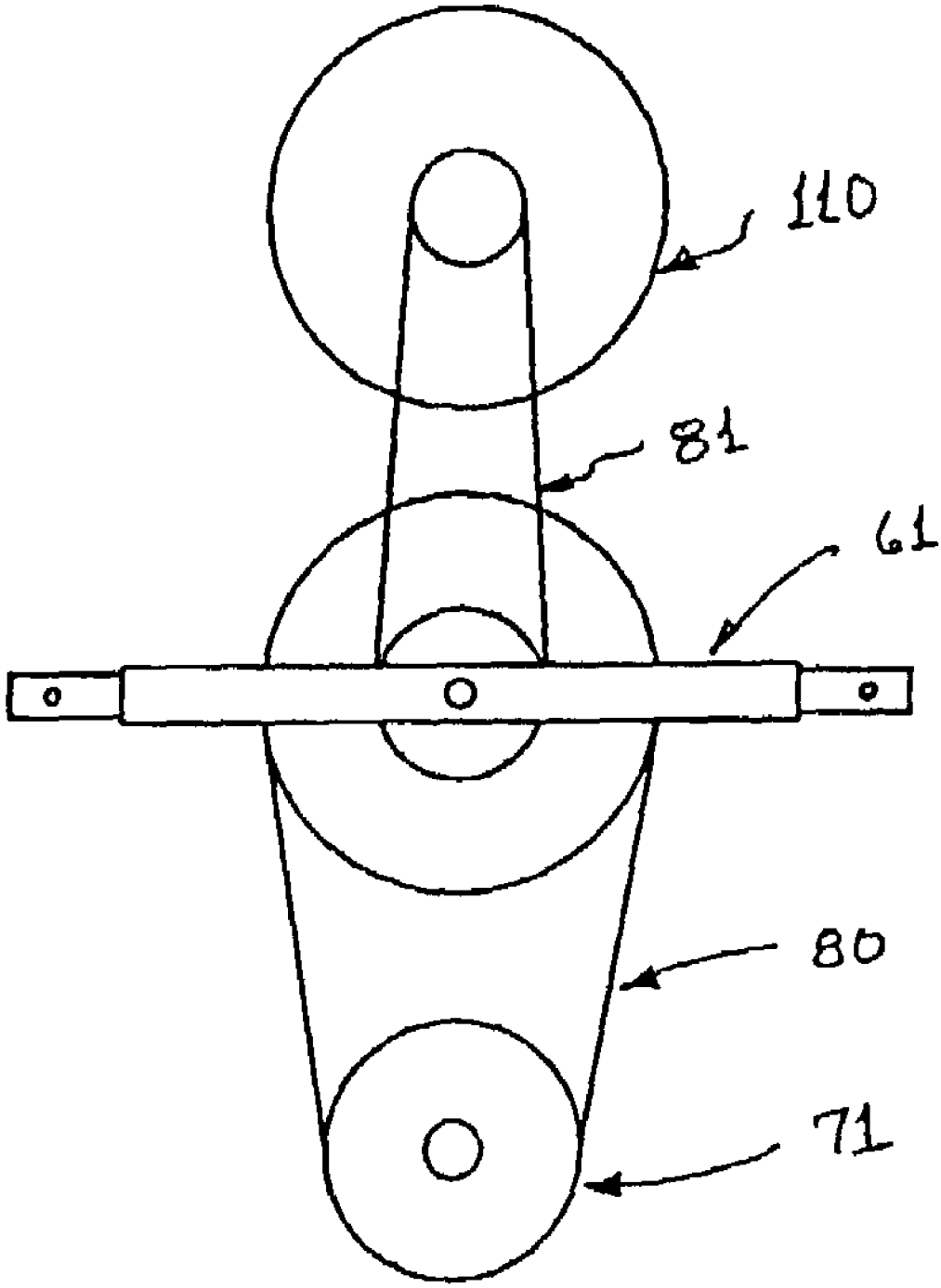
FIG. 11 demonstrates an optional resistance means which may be part of the motioning exercise apparatus.

FIG. 11 demonstrates a resistance means 110 which may be part of the apparatus. It may connect to the power transfer means 14 through a closed loop connection means 81 as shown, be part of a gear assembly, or be some other commonly known connection. The resistance means may be any type of commonly known resistance component, such as a flywheel with a tension belt, a magnetic resistance component, an electromagnetic component, etc.

The resistance means mentioned above is considered optional because it is possible for the user to utilize their own muscles for resistance. For example, the user may push and pull on the handle members, and use their body muscles to resist movement of the seat, thus providng resistance to the movement of the handle members. The reverse is also true in that the user may produce the pivoting motion of the seat, and use their body muscles to resist movement of the handle members, which provides resistance to seat movement.

Many variations of the motioning exercise apparatus exist, along with the configurations described above. While it will be apparent that the preferred embodiment of the invention herein disclosed is well calculated to fulfill the objects above stated, it will be appreciated that the invention is susceptible to modification, variation, and change without departing from the proper scope or fair meaning of the subjoined claims.

I claim:

1. A motioning exercise apparatus comprising:

a frame means;

a seat support means comprising a generally horizontal seat pivotally mounted to said frame means such that said seat pivots in the generally horizontal plane;

a hand engagement means comprising two upwardly extending handle members pivotally attached to said frame means through an attachment means, said handle members moveable in the forward and backward directions with respect to said frame means, such that said handle members pivot in the generally vertical plane, a power transfer means operatively connecting said hand engagement means and said seat support means, said power transfer means comprising a transfer member pivotally mounted to said frame means such that said transfer member pivots in the generally horizontal plane;

whereby pivoting said handle members in the general forward and backward directions produces pivoting movement of said seat in the general clockwise and counter-clockwise directions, and pivoting said seat in the general clockwise and counter-clockwise directions produces pivoting movement of said handle members in the general forward and backward directions.

2. The motioning exercise apparatus as claimed in claim 1, said seat support means further comprising a generally upwardly extending seat support member pivotally mounted to said frame means such that said seat support member pivots about a generally vertical axis; and a back support means.

3. The motioning exercise apparatus as claimed in claim 2, said frame means comprising;

a base structure having an attachment means for pivotally attaching the lower ends of said handle members;

a seat mount used to pivotally support said seat support means;

a power transfer mount used to pivotally support said power transfer means.

4. The motioning exercise apparatus as claimed in claims 1, said transfer member of said power transfer means being a lever, said power transfer means further comprising;

power transfer connection members connecting said handle members to said lever, a lever support member pivotally mounted to said frame means, behind said seat support member, and extending from said frame means in the generally upward direction; said lever being generally horizontal and rigidly mounted at its proximate center to said lever support member, at a generally perpendicular angle, said lever member having lever end segments rotatably mounted at each end, said lever end segments also being moveable along the respective ends of said lever in the inward and outward directions, said power transfer connection members being pivotally mounted at one end to said lever end segments and at the opposite ends to said handle members;

a lever rotatable member rigidly mounted to said lever support member;

a seat rotatable member rigidly mounted to said seat support member;

a closed loop connection means operatively connecting said lever rotatable member and said seat rotatable member, such that rotation of said lever rotatable member produces rotation of said seat rotatable member, and rotation of said seat rotatable member produces rotation of said lever rotatable member;

said seat rotatable member and said lever rotatable member rotating in the same direction, with said seat rotatable member rotating faster than said lever rotatable member.

5. The motioning exercise apparatus as claimed in claim 1 further comprising at least one upwardly extending thigh engagement member rigidly mounted to said seat, said thigh engagement member being used to produce pivoting movement of said seat in the clockwise and counter-clockwise directions, said thigh engagement member also being used to resist movement of said seat in the clockwise and counter-clockwise directions.

6. The motioning exercise apparatus as claimed in claim 1 further comprising a resistance means operative connected to said hand engagament means and said seat support means for resisting pivotal movement of said hand engagement means and said seat support means.

7. A motioning exercise apparatus comprising:

a frame means having a front and rear area;

a seat support means comprising a generally horizontal seat pivotally mounted to said front area of said frame means such that said seat pivots in the generally horizontal plane;

a hand engagement means comprising two upwardly extending handle members pivotally attached to said frame means through an attachment means, one handle member mounted to the general right side of said seat, and the other handle member mounted to the general left side of said seat, said handle members moveable in the forward and backward directions, to the general right side and left side of said seat, such that said handle members pivot in the generally vertical plane;

a power transfer means operatively connecting said hand engagement means and said seat support means, said power transfer means comprising a transfer member pivotally mounted to the rear area of said frame means, said transfer member having a right and left side, said handle member mounted to the right side of said seat operatively connected to the right side of said transfer member, said handle member mounted to the left skin of said seat operatively connected to the left side of said transfer member, such that pivoting each of said handle members in the backward direction produces motion of the respective side of said transfer member in the backward direction, and pivoting each of said handle members in the forward direction produces motion of the respective side of said transfer member in the forward direction;

whereby pivoting said handle members in the general forward and backward directions produces pivoting movement of said seat in the general clockwise and counter-clockwise directions, and pivoting said seat in the general clockwise and counter-clockwise directions produces pivoting movement of said handle members in the general forward and backward directions.

8. The motioning exercise apparatus as claimed in claim 7, said seat support means further comprising a generally upwardly extending seat support member pivotally mounted to said frame means such that said seat support member pivots about a generally vertical axis; and a back support means.

9. The motioning exercise apparatus as claimed in claim 8, said frame means comprising;

a base structure having an attachment means for pivotally attaching the lower ends of said handle members;

a seat mount used to pivotally support said seat support means;

a power transfer mount used to pivotally support said power transfer means.

10. The motioning exercise apparatus as claimed in claims 7, said transfer member of said power transfer means being a lever, said power transfer means further comprising;

power transfer connection members connecting said handle members to said lever;

a lever support member pivotally mounted to said frame means, behind said seat support member, and extending from said frame means in the generally upward direction; said lever being generally horizontal and rigidly mounted at its proximate center to said lever support member, at a generally perpendicular angle, said lever member having lever end segments rotatably mounted at each end, said lever end segments also being moveable along the respective ends of said lever in the inward and outward directions, said power transfer connection members being pivotally mounted at one end to said lever end segments and at the opposite ends to said handle members;

a lever rotatable member rigidly mounted to said lever support member;

a seat rotatable member rigidly mounted to said seat support member, a closed loop connection means operatively connecting said lever rotatable member and said seat rotatable member, such that rotation of said lever rotatable member produces rotation of said seat rotatable member, and rotation of said seat rotatable member produces rotation of said lever rotatable member;

said seat rotatable member and said lever rotatable member rotating in the same direction, with said seat rotatable member rotating faster than said lever rotatable member.

11. The motioning exercise apparatus as claimed in claim 7 further comprising at least one upwardly extending thigh engagement member rigidly mounted to said seat, said thigh engagement member being used to produce pivoting movement of said seat in the clockwise and counter-clockwise directions, said thigh engagement member also being used to resist movement of said seat in the clockwise and counter-clockwise direction.

12. The motioning exercise apparatus as claimed in claim 7 further comprising a resistance means operative connected to said hand engagament means and said seat support means for resisting pivotal movement of said hand engagement means and said seat support means.

* * * * *